US008272801B2

(12) United States Patent
Linzell

(10) Patent No.: US 8,272,801 B2
(45) Date of Patent: Sep. 25, 2012

(54) MULTI-FUNCTION SURFACE TREATMENT TOOL

(76) Inventor: Geoffrey Robert Linzell, Hatfield (GB)

( * ) Notice: Subject to any disclaimer, the term of this patent is extended or adjusted under 35 U.S.C. 154(b) by 452 days.

(21) Appl. No.: 11/569,482

(22) PCT Filed: May 20, 2005

(86) PCT No.: PCT/GB2005/002014

§ 371 (c)(1),
(2), (4) Date: Nov. 21, 2006

(87) PCT Pub. No.: WO2005/112688

PCT Pub. Date: Dec. 1, 2005

(65) Prior Publication Data

US 2007/0209133 A1 Sep. 13, 2007

(30) Foreign Application Priority Data

May 22, 2004 (GB) ..... 0411467.4
Feb. 25, 2005 (GB) ..... 0503904.5

(51) Int. Cl.
*B43K 5/00* (2006.01)
*B05C 11/00* (2006.01)

(52) U.S. Cl. ..... 401/261; 401/266; 15/209.1

(58) Field of Classification Search ..... 401/261, 401/266, 139, 48, 137, 132–135; 15/114, 15/117, 118, 229.13, 209.1, 104.94
See application file for complete search history.

(56) References Cited

U.S. PATENT DOCUMENTS

| | | | | | |
|---|---|---|---|---|---|
| 2,037,944 | A | * | 4/1936 | Steinhardt | 15/209.1 |
| 2,927,335 | A | * | 3/1960 | Hammond | 401/184 |
| 4,014,616 | A | * | 3/1977 | Mast et al. | 401/292 |
| 4,084,910 | A | * | 4/1978 | LaRosa | 401/133 |
| 4,303,348 | A | * | 12/1981 | O'Brien | 401/137 |
| 4,430,013 | A | | 2/1984 | Kaufman et al. | |
| 4,893,956 | A | * | 1/1990 | Wojcik et al. | 401/130 |
| 4,925,453 | A | * | 5/1990 | Kannankeril | 604/378 |
| 4,946,454 | A | * | 8/1990 | Schmidt | 604/385.19 |
| 4,963,045 | A | * | 10/1990 | Willcox | 401/132 |
| 5,230,119 | A | * | 7/1993 | Woods et al. | 15/209.1 |
| 5,590,439 | A | | 1/1997 | Alazet | |
| 5,771,524 | A | * | 6/1998 | Woods et al. | 15/209.1 |

(Continued)

FOREIGN PATENT DOCUMENTS

WO 00/32321 A1 6/2000

*Primary Examiner* — David J. Walczak
*Assistant Examiner* — Jennifer C Chiang
(74) *Attorney, Agent, or Firm* — Fox Rothschild LLP

(57) ABSTRACT

A tool for treating a surface by rubbing and including means to dispense onto the surface stuff, for example, a lotion for skin treatment, and including also a pair of opposed fins which are supported by a stiff, tapered, upstanding spine portion that traverses the tool and has an upper radial face for wiping and scrapping stuff, the fins extending laterally of and along the lower length of the spine portion and having an under face for rubbing contact with the surface, and each fin having optionally an upper absorbent face on each side of the spine portion to provide a swabbing capability, and the tool having a distal end and a proximal end, with the upstanding spine portion narrowing toward the distal end of the tool and the spine portion being hollow and shaped towards the proximal end for holding of the tool directly or coupled to a holdable object and also a method for making the tool.

25 Claims, 6 Drawing Sheets

Figure 1:
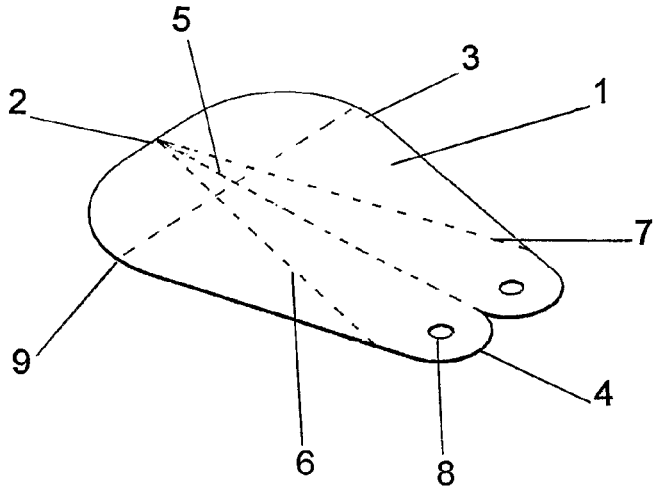

U.S. PATENT DOCUMENTS 5,772,346 A * 6/1998 Edwards ..... 401/132
D404,814 S * 1/1999 Mayer ..... D24/125
5,900,068 A * 5/1999 Thomas ..... 134/6
5,915,869 A * 6/1999 Agosto et al. ..... 401/201
5,957,605 A * 9/1999 Cohen et al. ..... 401/132
6,007,264 A * 12/1999 Koptis ..... 401/132
6,493,898 B1 * 12/2002 Woods et al. ..... 15/209.1
6,676,501 B2 * 1/2004 Beaudry ..... 451/533
7,310,847 B2 * 12/2007 Bolkan et al. ..... 15/118
7,686,793 B2 * 3/2010 Mizutani et al. ..... 604/385.17
2002/0026678 A1 * 3/2002 Gustafsson et al. ..... 15/209.1

* cited by examiner

3/6

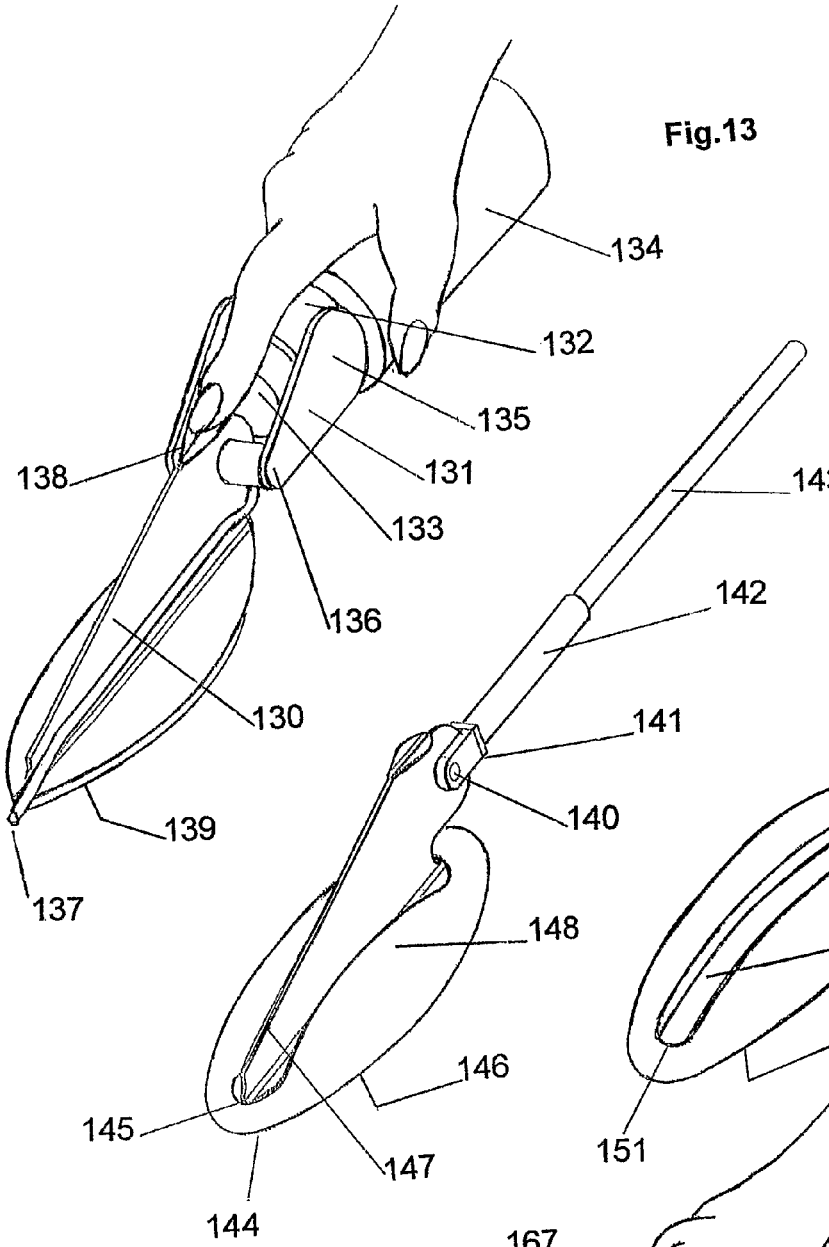
Fig.13
Fig.14
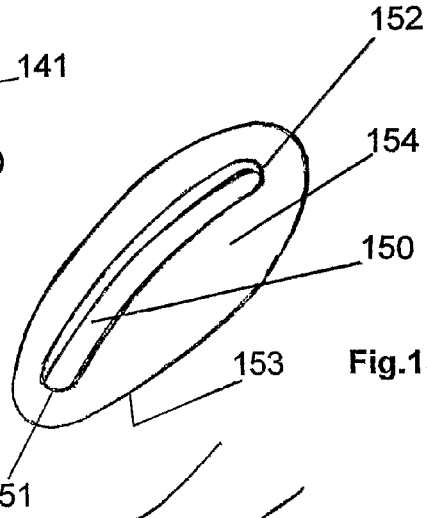
Fig.15
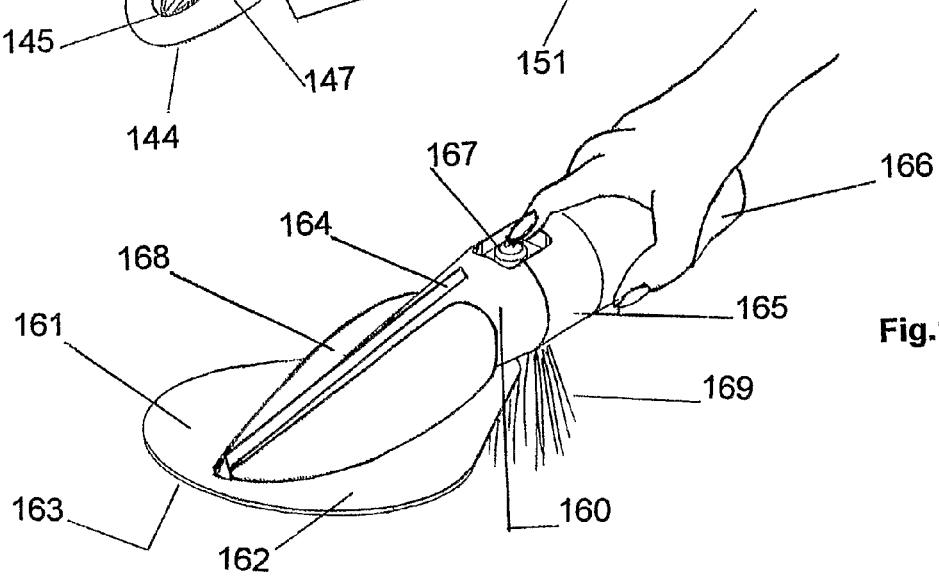
Fig.16

MULTI-FUNCTION SURFACE TREATMENT TOOL

CROSS-REFERENCE TO RELATED APPLICATIONS

This application is the National Phase entry of PCT/GB2005/002014, filed May 20, 2005, which claims priority to British patent application number 0411467.4, filed May 22, 2004 and British application number 0503904.5, filed Feb. 25, 2005.

FIELD OF THE INVENTION

The present inventions relates to chemical-mechanical surface treatment Tools for treating and cleaning surfaces, the Tools dispense and collect up stuff and are made with layered materials.

BACKGROUND

This invention addresses problems associated with treating and cleaning surfaces as encountered in many areas of human activity like domestic and institutional cleaning, cleaning automobiles, personal care, first aid and manufacturing. The problem is the inconvenience caused by the number of actions and items required to treat and clean a surface, the effort involved and risks associated with repeated exposure of hands to chemicals.

What is needed is a Tool shaped to perform many common tasks that are encountered when treating widely different surfaces, that is easy to make and safe to use and can be sized up or down to suit the area to be treated.

Thus the problem to be solved is the design of a Tool, a multi-function Tool for treating and cleaning surfaces by rubbing, the Tool able to follow complex shapes and reach into recesses as it treats the surface by applying and spreading stuff, then agitating the stuff to maximise its effect, then removing residues and finally wiping the surface dry and clean while keeping hands safely removed clean and dry.

A solution is to create a hand holdable Tool shaped to be used with a dispenser and preferably joined to the dispenser, the size of this combination then scaled up or down to suit the area to be treated. The Tool will require a multiplicity of flexible rubbing faces distant from a holdable area thereby keeping the users hands removed from dispensed stuff during use.

Such a Tool can be fashioned with a tapering main feature that acts like a stiff cantilevered beam or spine that carries and supports a multiplicity of protrusions each with flexible finlike features that are used as rubbing faces. The stiff spine traverses the Tool and has means of coupling at proximal end onto dispensing device of roughly similar proportions (size), allowing a stuff dispenser reservoir to be shaped and used as a handle to hold the Tool.

Tool bodies with appended rubbing faces are easily made with sheet cardboard, plastics or metals, faces covered with rubbing materials; rough for spreading and rubbing stuff in, smooth and compliant for scraping up, soft and absorbent for wiping off or swabbing up residues from treated surface.

A hand holdable Tool as outlined above might be termed a mid-size Tool for treating mid size surfaces such as commonly encountered in domestic cleaning. Larger Tools are used for institutional cleaning, manufacturing and automotive after-markets. It may become impractical to hand hold a larger stuff container, therefore a stand alone stuff container is used joined by flexible hoses to the Tool mounted on a hand held dispenser head. If on the other hand the Tool is made smaller, for use with personal care or first-aid products, the dispenser and its container are small and may be incorporated into the Tool, in which case the Tool is held gripped between fingers and stuff is progressively squeezed out from an integral enclosure during rubbing. The basic shape and means of manufacture and method of use however can be common to all three sizes of Tool.

More specifically this is a Tool for treating surfaces by rubbing with rough rubbing faces on finlike protrusions appended to a stiff spine. The spine tapered in at least one plane towards Tool distal end and broadens and stiffens towards proximal end for holding. The spine carries a separate stiff dorsal fin for wiping and scraping and further flexible faces for wiping dry.

There are many examples of single and double faced rubbing Tools known in the art. For example knives, trowels, spatulas and many other bladed Tools with rubbing faces bounded by cutting or scraping edges. The subject invention improves over these as a treatment tool by using separate rubbing and wiping (scraping) surfaces so that it's rubbing face is made rough and has varying flexibility while the wiping face is stiffer and smoother. The invention further improves by adding more rubbing capability by adding extra discrete working faces enabling it to both put down and take up material.

The invention therefore improves over prior art by providing a utility design for a multifunctional Tool that can be sized to suit most surfaces. The Tool carries a multiplicity of rubbing surfaces that are separate and are used separately and the Tool is used with a separate dispensing device.

More specifically the Tool is used with a stuff dispenser for applying dispensed stuff to a treatable surface, spreading it over, rubbing it against then wiping off residues from that surface, the Tool comprising:

a stiff spine-portion tapering towards distal end and shaped for hand-holding or coupling to a hand-holdable dispenser towards proximal end, the spine-portion has lateral finlike protrusions attached towards distal end, both spine and protrusions carry working faces, the Tool's rubbing capability is provided by the first face, which is the underface of the finlike protrusions, these have a stiff central region and flexible peripheral regions and are rough for spreading dispensed stuff and treating a surface, the Tool's wiping capability is provided by the Tools second face located on the spine and is separate from the first face, the second face being stiffer and smoother than the first face and is used to remove treatment residues.

SUMMARY OF INVENTION

In one aspect there is a Tool provided for treating surfaces by rubbing, with means enabling a stuff dispenser to be connected thereto for applying dispensed stuff to a treatable surface, spreading it over, rubbing it in, and wiping residues off that surface, the Tool with:

a stiff spined-portion tapering down towards Tool distal end, carrying lateral finlike protrusions appended to a tapered profile on spine spined-portion with means of holding towards Tool proximal end rubbing capability provided by underface of appended fin wiping capability provided by face on spine distant from underface.

DESCRIPTION

The term "Tool" is used herein to describe a utility shaped device for treating surfaces by rubbing and these surfaces are referred to hereinafter as "treatable surfaces". In principle the Tool is suitable for treating most solid surfaces in some useful way. Treatable surfaces are found in environments such as a home and include walls, windows, tiles, showers, baths, toilets, work surfaces, fabric drapes and coverings including floors such as carpets, tiles, timber floors and linoleum. Other treatable surfaces include wheels, windscreens, external bodywork and internal trim on transportation vehicles such as automobiles, trains, aircraft and boats. Examples of treatable surfaces for personal care include teeth, hair and skin; uses for teeth include cleaning and miniature whitening pads where the chemical-mechanical action can be beneficial; uses on hair include applying colouring, setting lotions, gel, conditioning agents, lubricants and shampoo applicators that massage and exfoliate the scalp; uses for skin treatments include exfoliation, cleaning and conditioning to reduce the appearance of ageing and defects, applying and removing cosmetics and applying trans-dermal treatments and first-aid to skin wounds. The Tools are useful for applying industrial treatments to conditioning surfaces for example priming to improve adhesion and wetting on metals, glass, plastics and ceramics.

The Tool is used to treat surfaces by rubbing before, during and after a treatment stuff is applied to the treatable surface. The treatment stuff is chosen to be able to flow during application and is applied to the surface by a stuff dispenser coupled to the Tool. The dispenser is either housed within Tool, directly coupled externally thereto or remotely connected via hoses.

The term "stuff" describes a material used for some purpose, it may be powder, liquid or gaseous, such as oxygen, air or vapour, aerosol, liquids or lotions, including water and oil emulsions and highly viscous wax like substance; any of which are applied to surfaces and spread over the surface for the purpose of treating that surface to influence the surface in some way, like for instance surface energy effects such as wetting, adhesion, friction; or other physical effects like absorption, adsorption, reflection (colour) and charge transfer and insulation (electronic). Treatable surfaces are those known in the art to be capable of useful interaction with or may be cleaned with applied stuff or may have its appearance changed by applied stuff. The stuff may contain any of the common chemical formulation elements both organic and inorganic ranging from passive to highly reactive caustic materials. By way of a guide typical treatment stuff include surfactant carrying soaps, washes and rinses; skin care and cosmetics stuff including fine powders, lotions, colouring compositions; first aid and medical stuff include antiseptics and anaesthetics; industrial stuff includes solvents, etchants, coatings, water replants, polishes, paints, marker dyes, lubricants and grip enhancing anti-lubricants.

The Tools are particularly useful for applying treatments where it is advantageous to mechanically clean the surface as the treatment stuff is applied, for example this can modify surface oxides by boosting chemical adsorption during rubbing, this is referred to as chemical-mechanical action.

Stuff like a lotion for skin treatment, may be a liquid with dispersed fine solids suspended therein; thus the stuff may range from a pure liquid to relatively thick pastes or gels' or greases carrying solids, providing the stuff can be spread into a thin layer or film across a surface with the first face of Tool. If the stuff contains solids that are harder than the surface being treated they act as abrasives. In other cases the solids are softer than the surfaces being treated, but harder than deposits on the surface and act as scourers.

Stuff with surface active constituents (often referred to as surfactants) is used for cleaning because they penetrate under deposited dirt and loosen it for removal by the mechanical action of the Tool.

The stuff may be dispensed from one or more orifices positioned on the Tool or from a dispenser attached adjacent to the Tool, dispensing either directly onto the treatable surface or onto a pad attached to the Tool that is then used to rub stuff against the treatable face. It was found practical to direct stuff downwards from conventional aerosol spray nozzles directly onto the treatable surface via an opening in the underface of the Tool. Trigger pump dispensers are more suited to dispensing stuff via an extension tube through a directional orifice at the tip of the distal end of Tool where the amount of stuff dispensed can be more readily visually monitored.

The Tool has a first and second work face. The first face is used for rubbing, to pre-condition a surface, applying and spreading dispensed stuff evenly over a treatable surface and then to treat the treatable surface by further rubbing. The second and optional further faces are used for wiping off residues and drying. The first and second faces are separate, with the second face located at a distance from the first face, both carried on the supporting spined-portion. The first face is the area formed by the under-face of finlike protrusions appended to the spined-portion. The second face is an area on a separate finlike protrusion that resembles a dorsal fin located on the spined-portion distant from first face. A further optional face the 'third face' for swabbing is located on the upper faces of the finlike protrusion that formed the first face. Subsequent faces may be added by adding more finlike protrusions and these are numbered in sequence of use. In principle the utility aspect of the basic Tool shape allows Tools to be joined and used together; for example joined back to back (joined at proximal ends to form larger mops) or stacked one on top of the other with suitably shaped interlocking spines and with the upper tool inverted to provide a larger second face for rubbing.

The term "rubbing" or 'to rub' is used herein to mean "come into or be in sliding contact, exercise friction" as defined in the Concise Oxford Dictionary. The Tool's first face is used to manage the dispensed stuff, first to spread it and ensure good coverage (wetting in the case of fluids) and maximise its chemical action and interactions with the treatable surface by agitation (rubbing), Tool's second and third faces used to remove residues.

The term "friction" means resistance to sliding movement generally the result of interlocking roughness between rubbing surfaces or mild abrasion between surfaces. The force to overcome lateral resistance during rubbing is proportional to normal force pressing the Tool against the treatable surface.

The term "wiping" or 'to wipe' is used herein to mean "clean or dry surface by rubbing" as defined in the Concise Oxford Dictionary. Therefore the Tool provides a multiplicity of faces that provide (exercise) sliding frictional contact with a treatable surface through working faces appended to a spined-portion, the rubbing faces made rougher than wiping faces.

The term "rubbing" as used herein includes "scrubbing", which is rubbing with a relatively rough Tool face such as with stiff fibres; whereas the term "wiping" is used herein to describe the subsequent removal of residues and the final cleaning and drying that completes the surface treatment and there may be more than one wiping steps. First wiping is done with the second face that is a stiff dorsal finlike edge on the spined-portion and is used with a scraping action. Scraping is affected with a defined relatively smooth edge that is locally compliant to ensure efficient removal of fluid residues from within local micro-roughness by squeegee action as the close fitting edge is wiped over the surface. The scraper edge usually coated with a moderately elastic non-absorbent non-porous rubber like composition. Optional second wiping is done with third face using an absorbent swab to soak up and dry and done with material like micro-fibre, sponge or cloth and combinations thereof. The meaning of "wiping" as used herein includes "scraping" and "swabbing" because both involve a rubbing frictional contact with the treatable surface.

The term "spined-portion" describes a central feature of the Tool, a flexible beam that traverses the Tool and supports the rubbing faces; the spine is the part or portion of the Tool that links the other parts of the Tool together. The spined-portion is tapered. The term "taper" is defined in the Concise Oxford Dictionary as "growing gradually smaller towards one end like a cone or pyramid". Thus the 'spined-portion', grows gradually smaller towards one end, the Tool distal end.

The spined-portion carries appendages attached to a tapering edge or face on the spined-portion that resemble fins and are therefore variously described herein as fins or are said to be finlike. The Concise Oxford Dictionary defines the term "fin" as a small projecting surface or attachment, on streamlined bodies quoting fish or aircraft as examples and used for the purpose of stabilising or guidance. The Dictionary uses the term "finlike" to describe a small protrusion introduced to improve a function. The Tool fins are not small compared to the spined-portion but the concept of a protrusion appended to a spined-portion is perhaps more analogous to a flat fish where it is difficult to distinguish between fin and body. Therefore the terms fin and finlike are used herein to describe a shaped appendage and not their function.

The appendages protrude laterally in opposite directions and combine to provide a notionally flat under-face that is the main rubbing face, the first face; thus they are referred to hereinafter as protruding appendages.

Description of Tapered Tool Construction

The Tool body needs to be bendable to facilitate access and reach around obstacles and then to recover its shape. It is therefore made of material with elastic and plastic properties that deforms with significant bending and springs back fully. If made of sheet material it must also be plastically deformable beyond this spring-back point (yield point) so that it can be permanently deformed and shaped into a Tool that bends and recovers but does not stretch longitudinally during use. The work faces of the shaped Tool must remain more flexible than the stiff spined-portion so they can follow small-scale undulations and surface roughness. Therefore the Tools are very preferably made with flexibly deformable material that is resilient.

A practical and economic way of manufacturing Tools of virtually any size from a broad range of flexibly deformable sheet materials such as thick paper or cardboard, rubber, plastic film or foam, plastic/rubber blends or metal foil and laminated combinations thereof is as follows:

First: cut out a predetermined profile from a flat sheet of material.

Second: fold and form the cut-out into a three dimensional shape.

Third: add rubbing and wiping materials to working faces.

Fourth: join shaped Tool to a dispenser.

This folded construction provides a Tool shape with two opposing lateral finlike protrusions appended to a stiff upstanding tapered central spined-portion; the fins are appended to the spine's lower profile somewhat like pectoral fins. The underfaces of the lateral protrusions provide a rubbing capability and constitute the Tool first face. This face has a stiff central area becoming suppler away from the spined-portion. An area that runs along the upper profile of the spined-portion, (which resembles a dorsal fin), provides wiping capability and is the Tool second face. The upper face of the lateral pectoral fins is called the Tool third face and provides further wiping capability. The proximal end of the spined-portion sized and shaped for finger gripping.

The first face is used for rubbing and is made rough or is covered with a rough material; the second face is stiffer and is left smooth for wiping or scraping and it may be covered with a smooth material.

Typically low cost small Tools are made with thick paper or cardboard and cut to size and pre-creased, then water-proofed by laminating (that means covering) with thin plastic then packed flat for transportation. When un-packed the flat shape is bent along the creases to create the Tool shape and a rubbing material in the form of a slip-on shoe or shaped wipe is slipped over the rubbing under face, the shoe or wipe preventing the folded Tool from springing open or unfolding.

Small Tools made with thin plastics can be pre-creased and packed flat and used in a similar way. Larger plastic Tools may be thermoformed to shape from thicker sheet and then joined to an injection moulded dispenser mounting ring by thermo welding; or alternatively the entire Tool body can be injection moulded to form a stiffer shape. Metal Tools are cold formed and welded. More is said about materials and manufacturing later herein.

Description of Finlike Protrusions

There may be a single main finlike protrusion or most preferably two abutting laterally opposing finlike protrusions that form a single uninterrupted under-face these being the first face of the Tool. The first face is generally symmetrical, but may for functional reasons have asymmetrical features. The first face may be tapered like a lance or otherwise shaped like a blade and used like something between an artist's spatula knife and a bricklayer's trowel. It may have a pointed distal end for good access and fine control; thus the first face may be of virtually any shape ranging from a long thin blade to shorter generally circular, pear shapes, boat shaped, triangular or rectangular shapes. In the extreme case the fins may be flimsy wipe like elements like dusters appended onto and supported by the spined-portion. In all cases the Tools have a first and second face; these faces with distance between are located on separate finlike protrusions carried on a common spined-portion.

On small Tools the finlike first faces for rubbing may be stiff enough to maintain their shape flat, but can use more flexible material if made slightly curved in one or two axis to provide either a concave or convex rubbing face, which raises stiffness, the actual shape depending on the purpose of Tool. The first face is stiff where it attaches to the spine-portion and becomes less stiff and significantly flexible away from the spine. The edges of rubbing faces may be feathered (thinned) to provide progressively more flexibility and allow the edges to follow the micro contours of the surface being treated. Furthermore finlike appendages may be made sufficiently resilient to be folded flat or coiled up and held against spined-portion by an external means like a retainer ring, upon sliding the retainer off the fins then spring open ready for use.

On Tools with larger finlike protrusions further fin stiffening is provided by impressing grooved indentations into the first face, causing protrusions in upper face, the third face of Tool, these protrusions act as spars and braces. The impressed protrusion may intersect the spined-portion to maximise bracing and reduce hinging. Providing the fin material is sufficiently elastic, fins with protrusions are still able to bend and recover their shape repeatedly. Adding rubbing and wiping materials to the fin surfaces stiffens fins further.

Tools with significant width to depth ratios that resemble rectangular floor mops are made by adding significant lateral stiffness with large impressed lateral protrusions generally as described above. A wiping face or edge that acts like a squeegee is provided located removed above the surface. A further scraper edge may be added on top of a lateral impressed spar running at right angles to the spine. There are already many designs of floor mops with dispensers and most rely on natural convection drying which can leave significant dry marks. This invention offers the possibility of adding a squeegee scraper and swab to remove dirt laden residues, used by flipping the mop head over, thus the Tool handle coupling needs to be suitably versatile. This floor mop version of the Tool can be made with a dispenser joined or mounted adjacent to the Tool or the dispenser can be located away from the Tool and mounted on an extended handle, in which case the dispensed are fluids carried to the treatable surface via hose.

Description of Rubbing and Wiping Capability

The Tool is shaped to treat a surface by rubbing, first to spread and second to rub applied chemical against the surface to influence the surface and to maximise the chemical action by mechanical agitation and friction, which can be highly beneficial in driving chemical action. This combined chemical-mechanical treatment will vary depending upon the surface function, for example to improve adhesion to non-noble metals chemical-mechanical action cleans and raises surface energy and maximises wetting and adhesion; for exfoliating and treating skin with conditioning creams, mild abrasion and massage aids cleaning, removal of dead skin and improves adsorption; for domestic cleaning the major requirement is loosening dirt with surfactants then removal of debris and drying without leaving dry marks.

Generally for cleaning the Tools need a surface that provides enough friction to clean the surface of weakly adhering dry dirt or debris before treatment stuff is applied. After wetting with stuff, adsorbed materials such as airborne condensates and entrapped dirt within surface roughness, creases, folds and pores are loosened and removed and other tougher adhering materials such as dried on fluids or excretions, dirt splashed or otherwise physically transferred such as by wiping or some other form of contact are removed. The function of the rubbing Tool extends to the removal of material that is actually part of the surface or has been part of the surface, such as the removal of layers of dead skin material from the stratum corneum commonly referred to as exfoliation or the removal of corrosion products such as rust from steel. The function of the Tool further extends to the removal of absorbed matter and chemically bonded oxides from common surfaces like metals. Finally the function of the Tool extends to smoothing by reducing treatable surface roughness by abrasion especially on metals, skin and timber. In contrast the Tool is also useful for roughening up surfaces such as plastics to provide keying for inks or paints.

The faces of the fins provide relatively large rubbing areas onto which suitably textured facing material in the form of sheets or pads are attached. Materials used on the main under face, the rubbing face, may be any of those commonly used for treating treatable surfaces by frictional rubbing and therefore will have roughness. The rough material may vary from being extremely rough even abrasive to only very slightly rough and may typically be one or more of the following; woven or non-woven webs of natural or synthetic fibres with and without abrasive, wire wool, coated abrasive, formed film, foams, bristled sheets or combinations thereof. On large tools the bristled sheets are made with materials resembling flexible plastic door mats or artificial turf that when wet are very effective for cleaning soft paintwork.

Dissimilar rubbing materials may be incorporated around the edges of the first face or within face, such as brushes with bristles either pointing radially away outwards from the edge or downwards from some part of the under-face and especially near the edge. Thus a rubbing or wiping face on the Tool may comprise of more than one type of material for rubbing.

As previously noted the upper-side of the fin carrying the first face, the third face preferably has attached to it a material that absorb fluids, these materials for swabbing are foam, foam cloth combinations, pads including soft natural or synthetic fibres and micro fibre. Other materials such as velour or cotton pads may also be used on these faces for buffing up applied polishes.

The covering materials may be permanently bonded onto the rubbing faces by adhesives or thermo welding or may detachably attached by contact adhesive or mechanically attached by fibre hook and loop interlocks like Velcro (registered is a registered trade mark of Velcro USA Inc. Manchester N.H. USA). Finally the coverings may be made removable by shaping like a shoe to slip on or over or wrap over or around the edges of the rubbing face.

The first face of the Tool may have patterns indented into the surface of the fin and these will both stiffen it and may have functional rubbing benefits. Furthermore the rubbing face may be formed by the method described in our earlier patent application titled Flexible Formed Sheets for Treating Surfaces published as International Publication Number WO 2005/018879 A1. Thus either the actual fin material is formed or a separate layer is formed and then attached to the fin. These formed surfaces are multifunctional with provision for dispensing, rubbing then scraping off and retaining residues. Thus it is possible to make a multifunctional Tool with this construction using only one rubbing face on the Tool.

Description of Tapered Spined-Portion

The tapered spined-portion is hollow over part or all of its length. If folded flat the spined-portion may outwardly appear to be a single layer, however it is still considered hollow for the purpose of this specification. Thus the shape in cross section of the spine-portion may vary from being folded virtually flat to round, triangular or rectangular and may vary along its length. The shape tends to vary with Tool size, medium and especially the small Tool commonly use the folded flat cross-section, which in essence is a cone squashed flat and medium and large size Tools tend to use cone shapes with a hollow circular cross-section.

When viewed from the side a spine-portion, either a cone or squashed cone have a profile with top and bottom edges tapered. Protrusions are appended to the folded tapered edges on squashed cones and to tapered faces on round cones.

Both the cone and flattened cone have a straight stiff dorsal ridge along the top of the spined-portion. The finlike dorsal ridge has a smooth edge that is locally compliant and collects residues by squeegee action when wiping.

The spined-portion is tapered longitudinally to provide appropriate stiffness varying from a minimum at distal end to a maximum at the proximal end. The tapered spine portion facilitates access with distal end into narrow openings and difficult places.

The angle of taper of the spined-portion is chosen to remove the user's hands away from the treatable surface during rubbing, the preferred taper angle in the range 4 to 80° inclusive, and most commonly 8 to 40° inclusive.

Smaller Tools are most easily gripped on spine-portion between fingers; Tools with this construction being found suitable for basic applications in skin care and first-aid.

Viewed sideways, if the apex of the spined-portion terminates at or before the distal edge of the first face, the outline of the spined-portion appears trilateral. If the apex of the spined-portion reaches beyond the distal edge of first face, and the apex is cut off in line with the distal edge, then the outline appears quadrilateral. This applies irrespective of the cross section of the spined-portion.

Most Tools employ a single spined-portion, but Tools with large first faces may use more than one spined-portion running parallel or radiating in a spoke like fashion from the proximal end, in which case the fins between spines are appended to two spined-portions.

A hollow conical spined-portion resists twisting when the Tool is subjected to uneven longitudinal forces as encountered in scraping with a dorsal wiping face.

The hollow cone when made with elastic material provides a useful curve fitting characteristic as the round cross section deforms (squashes) readily into an ellipse when pressed hard against the treatable surface during rubbing, in extreme cases it may be compressed up to the point of collapsing flat over some part of the cone length to facilitate access into confined spaces. Providing the Tools are made of suitably resilient materials they recover their shape rapidly after such deformation. In more sophisticated Tools the stiffness of a hollow spined-portion and especially a cone shaped spined-portion may be varied by pressurising the inner cavity of the cone.

The end tip of a hollow spined-portion, in particular a cone shaped spine section may be terminated at right angles to the axis of the cone to provide a small yet separate rubbing face, which is useful for positioning a dispensing outlet. Also it is a useful mounting place for a bristle brush that reaches into difficult recesses when treating surfaces.

Description of Filled Spine-Portion

A hollow spine can be used to house functional items, but this will reduce and may in some cases eliminate the spine-portion flexibility. For example the cavity within the spine portion can be used to store collected up residues, for this it is either left empty of filled with a flexible absorbent material like sponge. Openings are provided into the spine-portion adjacent to the dorsal wiper/scraper face that allow collected up residues to flow into the hollow section, these opening may be designed to only open during scraping.

The hollow spine-portion may be formed and sealed then used as a stuff container from which stuff is dispensed or the hollow spine-portion may house a container and a dispenser, for example a squeezable bottle, aerosol or motor driven pump with reservoir.

Furthermore the hollow spined-portion can accommodate a mechanical mechanism, powered by electricity, pressurised air or water. The mechanism can advantageously be a vibrator that mechanically assists rubbing and at the same time help propel the Tool as it rubs the surface.

During rubbing, either manual or mechanically assisted, the Tool must be pressed against a treatable surface with sufficient force to cause friction as the Tool slides laterally. The actual rubbing force used will depend upon the hardness of the surface, hardness and strength of the substrate and the hardness of the Tool and it is difficult to give precise guidance on this detail. The Tool itself must be stiff enough to apply useful rubbing pressure and all Tools should be tested to ensure that its body is stiff enough to apply sufficient pressure to treat the treatable surface while the Tool face remains flexible enough to follow the shape contours of the treatable surface.

Description of Rubbing Vibrator

Manual rubbing is understood to be simple back and forward motion or circular motions and combinations of these. Mechanical assistance can be applied by introducing a vibrator unit into the hollow spined-portion located above the first face of the Tool. Vibrations are easily generated by rotating an eccentric weight with axis its parallel to the Tool axis. This creates a cyclical gyratory force the net effect of which is to propel the Tool sideways across the surface, rubbing as it travels; for this to be effective the cone must be elastic so part of the cone can move independent of the hand-holdable portion. The motion is now explained as the eccentric weight rotates through four quadrants of a revolution. In the first quadrant the eccentric travels towards the rubbed surface and increases contact pressure in the second quadrant the weight exerts a sideways force on tool, the first direction, in the third quadrant the weight travels away from surface and reduces contact pressure and in the fourth quadrant the weight exerts a sideways force in the opposite direction or the second direction. Because the contact force is greater for the first direction, friction is higher and hence the tool does not move as far as in the second direction where the friction is less. The net effect is the Tool moves further in the second direction than the first direction for each revolution of the eccentric weight.

The vibrator is preferably driven by a rotary motor, most preferably an electric motor. A battery pack that is optionally rechargeable can be accommodated with the motor and an eccentric weight within the tapered profile of the Tool. Reversing the direction of rotation reverses the direction of travel. The direction of rotation is reversed by reversing the polarity of the battery connection to a dc electric motor with a change-over switch.

The entire electrical package is hermetically sealable in a plastic bag to protect the mechanism from water ingression. Such a vibratory action is highly beneficial in applications as varied as cleaning car wheels or massaging and deep cleaning skin in difficult to reach places, for example on the back. Alternatively to avoid using electrics the eccentric weight in the vibrator may take the form of a ball blown around inside a tubular ring at high speed by compressed air or water to create a similar effect as the eccentric weight.

Description of Mounting Means for Connecting Tool to Dispenser

Means are provided for attaching the Tool to a dispenser and gripping the combined elements during rubbing. On small Tools the dispenser may be a squeezable blister button or a triangular sachet shaped to fit inside the triangular spined-portion or a formed film sheet with filled cavities attached direct to the underface either way the attached dispenser is positioned so that during the action of rubbing some external pressure is applied to the dispenser to ensure it dispenses. Small Tools may be attached to small dispensers and used for applying makeup dispensed with dispensers appropriate for this purpose such as a pencil brush or a propel-repel stick like a lipstick dispenser. For artistic purposes a small Tool may incorporate a paint or ink dispenser resembling a marker pen that is attached to the Tool.

The Tool may be permanently or detachably attached to the stuff dispenser on medium size Tools that use aerosol canisters or squeeze bottles or bottles with finger trigger or button pumps, which stuff holders when suitably shaped are gripped by hand and used as a handle to hold the Tool. The means of attachment is usually a mounting ring formed at the proximal end of spined-portion that presses onto or clips over a ridge on stuff holder.

Large Tools may use a separate hand held dispenser head, perhaps resembling a spray gun that is coupled to a reservoir by hoses, and the Tool then permanently or detachably attached to the dispenser by for example press fitting onto mating faces.

Small, medium and large size Tools may be mounted on rods to extend reach, in which case the connection to the dispenser is arranged so that the dispensing action is controlled from the hand holdable area on rod.

Description of Materials Used in the Construction of the Tools

The Tools are made with resilient flexibly deformable solids such as bonded fibrous materials like paper or cardboard sheet; woven and non woven fabrics stiffened by internal web bonding; polymer sheet moulded, extruded or foamed and thermo-formable; and cold formable metal foils; or some combination of these materials formed into laminated sheets.

If made with fibrous paper or cardboard the fibres may be natural or synthetic, the natural fibres being biodegradable. Cardboard is attractive because of low cost but it generally requires some protection from water ingression to prevent excessive softening and may be treated with a water repellent like silicone that is also biodegradable or may be plastic coated (laminated) after cutting into flat predetermined shapes and folded along creased folding lines to make the most basic Tools. By way of a guide small prototype Tools were made with 2 ply Bristol Board, a smooth medium pasteboard laminated with thermoplastic urethane film. Potentially any of the thermoplastic elastomers (TPE's) discussed below can beneficially be used as coatings especially those with pleasant skin like feel.

Woven and non-woven polymeric fabric sheet can potentially be formed (shaped) into Tools, the sheet imbued with sufficient stiffness to make attractive fabric like Tools. The following bonding processes are used for stiffening: chemical, thermal/mechanical or latex are all potentially suitable, of which thermal/mechanical is attractive because the forming and bonding can be done simultaneously with heated Tools, causing a small percentage of the non-woven fibres to fuse together. Typical heat fusible fibre (bonding fibre) has a central core of conventional synthetic fibre (e.g. polyester or nylon) and an outer sheath of a lower melting point fibre (polyester).

For making Tools sheet polymers, a thermoplastic, a polyolefin, in particular polyethylene and polypropylene are suitable because they are suitably flexible in use yet made structurally stiff enough by bending and bracing and can be readily formed by injection moulding or thermoformed by blow moulding and preferably by fold forming film over hot wire combined with selective thermoforming and welding.

Foam thermoplastic sheet, for example a high density polyethylene foam sheet such as that marketed as Plastazote® (a registered mark of Zotefoams Inc. 55 Precision Drive, Walton, Ky., 41094 USA) can also be readily cut and thermoformed as Tool bodies generally as described herein before.

A preferred material for skin contact being one of the many blown or cast film or extrudable thermoplastic elastomeric materials (TPE) that are processed like plastics but have physical properties more like those of rubber, and these materials are also ideal for squeegee action. These materials also feel pleasant to touch being soft and skin like. While these materials are relatively expensive, materials that are based on the notion of reversible cross-linked block copolymers of polystyrene-polybutadiene-polystyrene, referred to commonly as styrenic TPE materials are cheaper. TPE materials, especially thermo plastic urethanes (TPU's) may be co-extruded with the above mentioned polyolefin structural materials to reduce cost further while providing the highly desirable sensual feel of more expensive materials for personal care products.

If fluids are to be stored within the Tools then a flexibly deformable material with barrier layer properties must be used to prevent evaporation. Materials with barrier layers do not thermoform as easily because they include a very thin dense layer integrated into or attached onto a polyolefin structural sheet which makes them readily thermo weldable. Therefore a practical means of storing fluid within the Tools is to employ essentially flat squeezable capsules or pouches that are attached to the Tool surfaces so that in use they are first opened appropriately to allow regulated dispensing.

If made with metals the Tools are cold formed from a sheet of suitable thickness and ductility, a very suitable material being stainless steel; however it was found that the edges could be sharp and ideally should be folded for safety. Typically 304 or 316 series stainless steels are suitable, the gauge being determined by the size and stiffness required.

FIGURES

Seven examples of Tool construction are now described in greater detail with reference to the following twenty three figures:

FIG. 1—Shape of pre-form cut from flat sheet for making basic Tool

Figure 2:
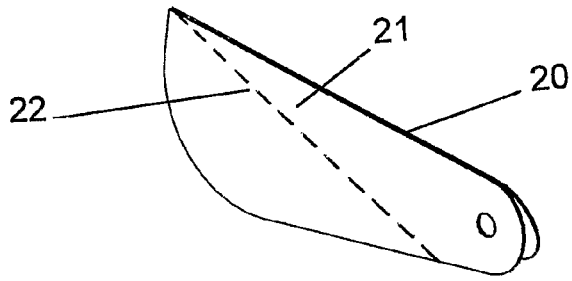

FIG. 2—First stage fold-form of pre-form

Figure 3:
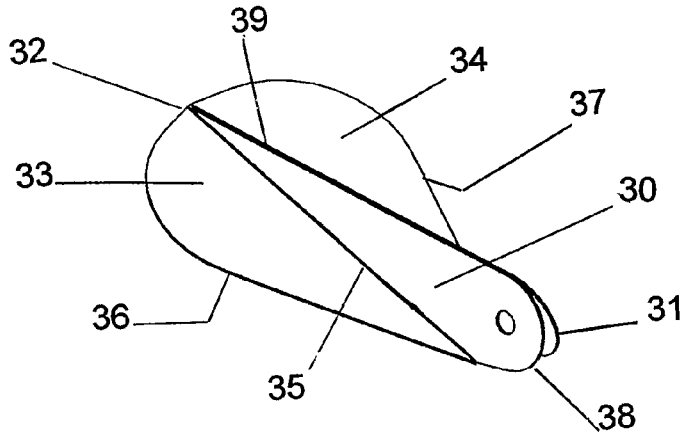

FIG. 3—Second stage fold-form creates tapered spine-portion with fins

Figure 4:
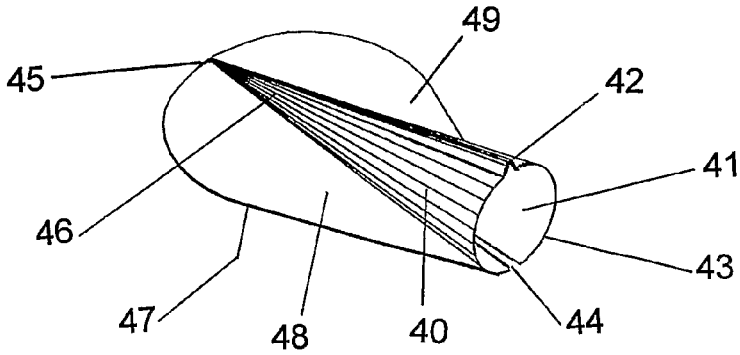

FIG. 4—Further forming stage to form cone shaped spine-portion

Figure 5:
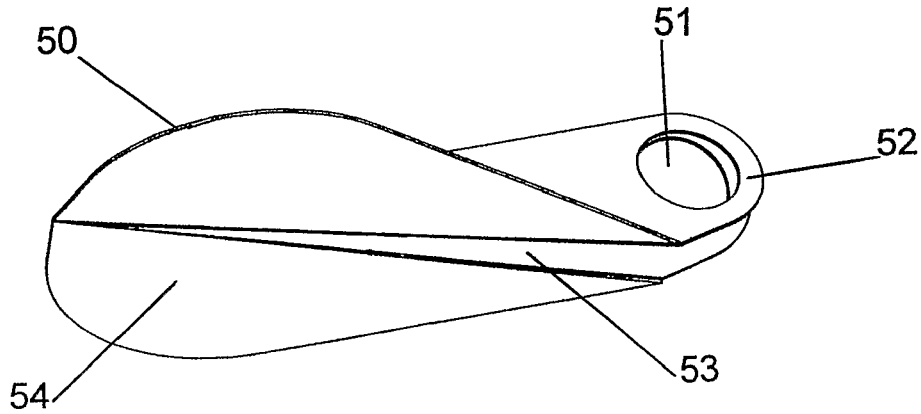

FIG. 5—Shows the under face of basic small Tool

Figure 6:
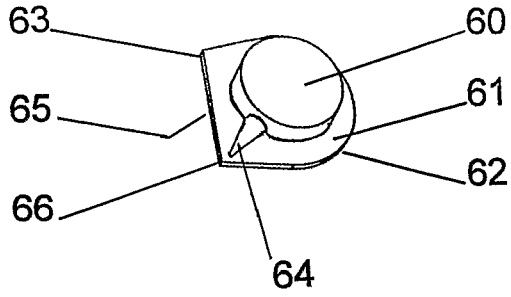

FIG. 6—Shows a dispensing capsule for attachment to small Tool

Figure 7:
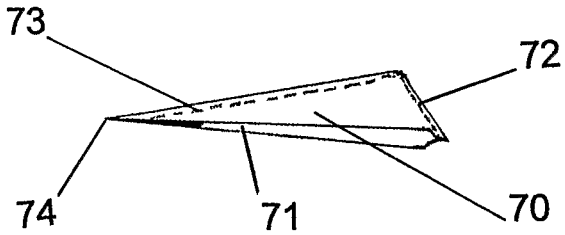

FIG. 7—Shows a dispensing pouch for attachment to a small Tool

Figure 8:
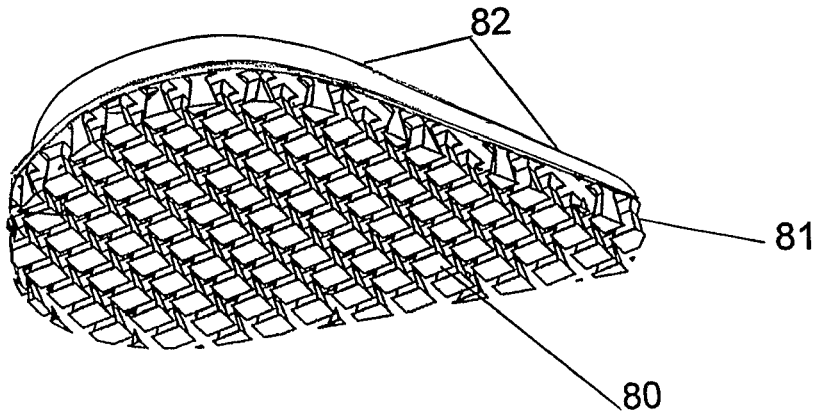

FIG. 8—Shows a formed dispensing sheet for attachment to a small Tool

Figure 9:
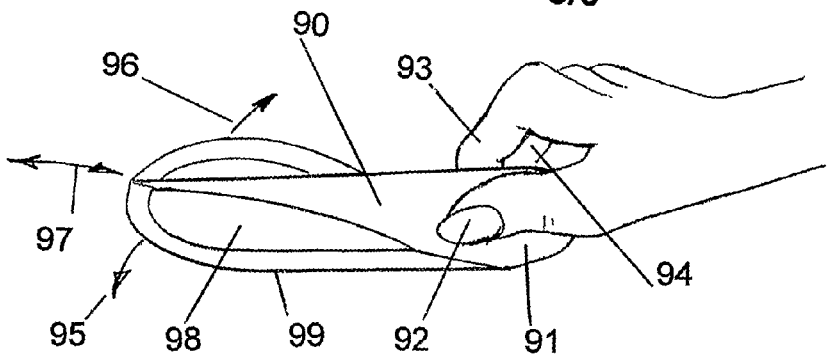

FIG. 9—Shows how small Tool is held and used for rubbing a flat surface

Figure 10:
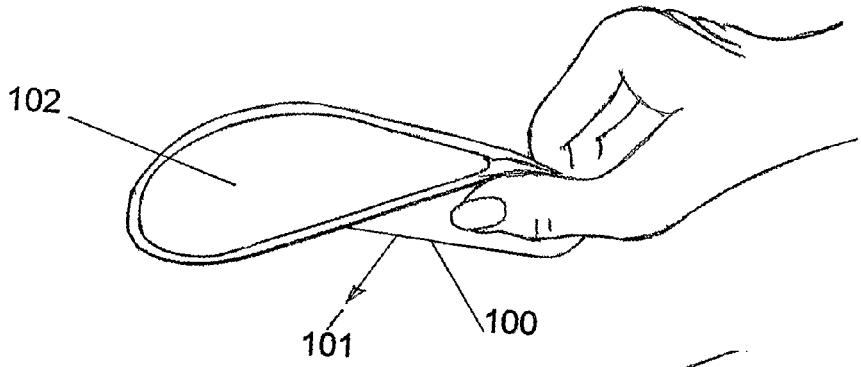

FIG. 10—Shows how small Tool is held and used for wiping a flat surface

Figure 11:
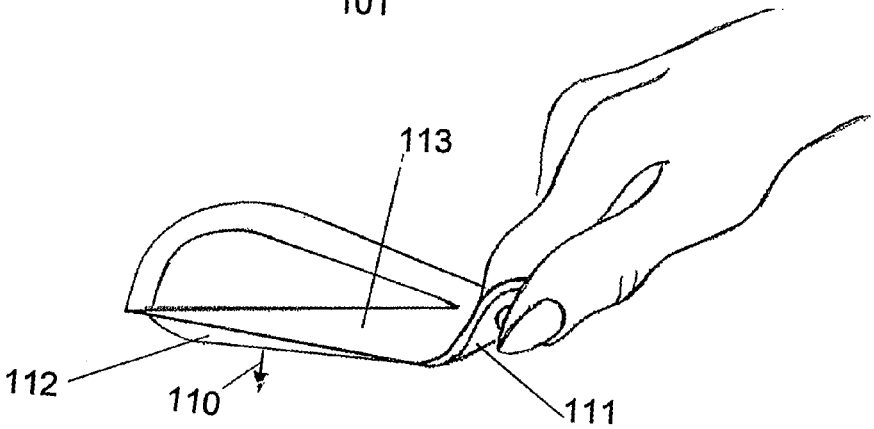

FIG. 11—Shows how small Tool is held and used for swabbing a flat surface

Figure 12:
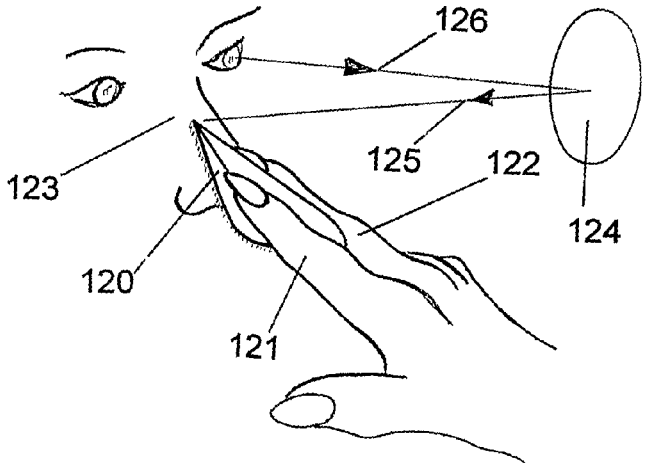

FIG. 12—Shows how small Tool is held and used for applying facial treatment

FIG. 13—Shows a medium size Tool with finger operated pump on dispenser

FIG. 14—Shows a medium sized Tool attached to a long reach pole

FIG. 15—Shows a slip-on work face cover for a typical Tool

FIG. 16—Shows a medium sized Tool connected to an aerosol dispenser

Figure 17:
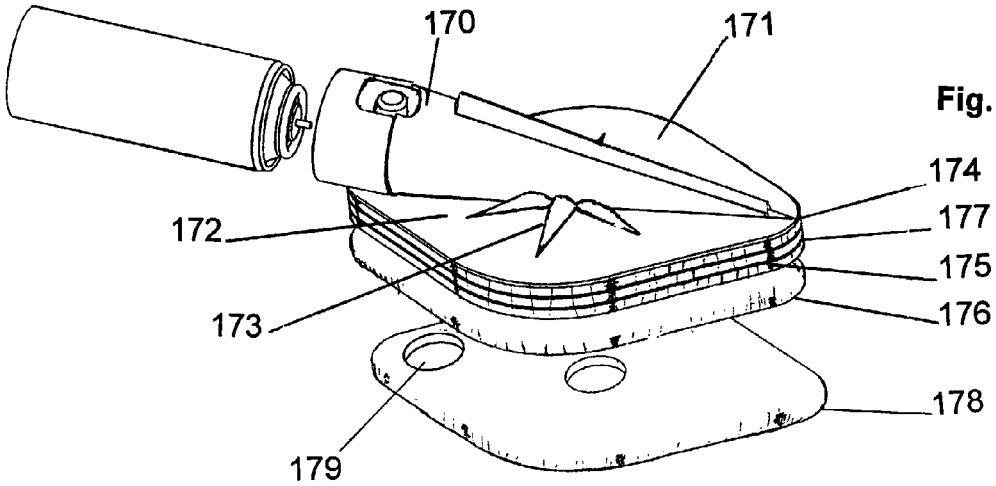

FIG. 17—Shows a large size Tool with cone spined-portion and peel off pads

Figure 18:
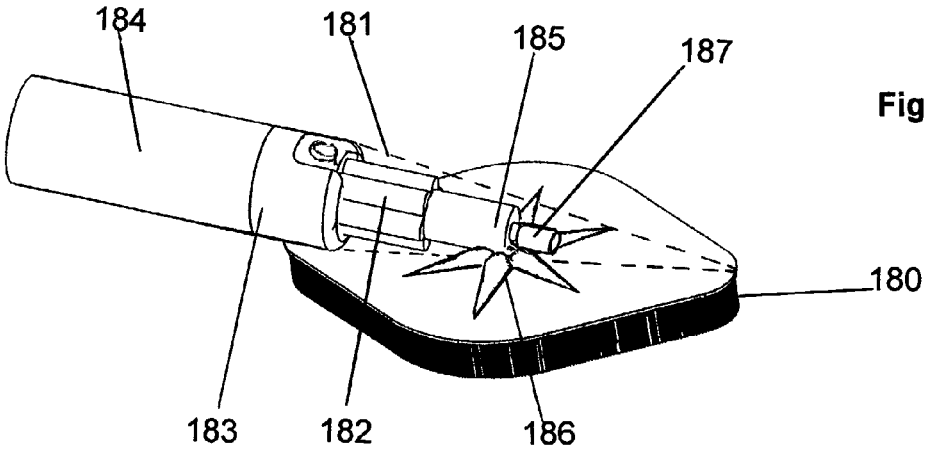

FIG. 18—Shows a large Tool with motor driven vibrator within cone

Figure 19:
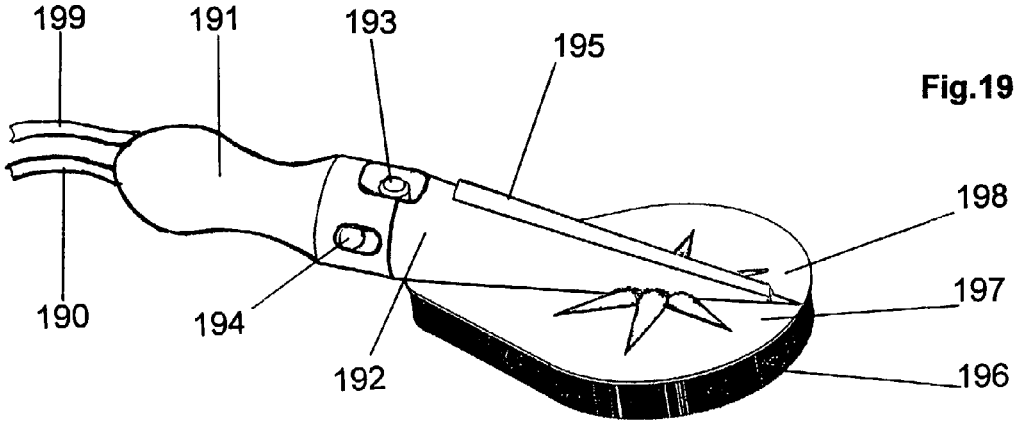

FIG. 19—Shows a large Tool with different shaped fins and brush under-face

Figure 20:
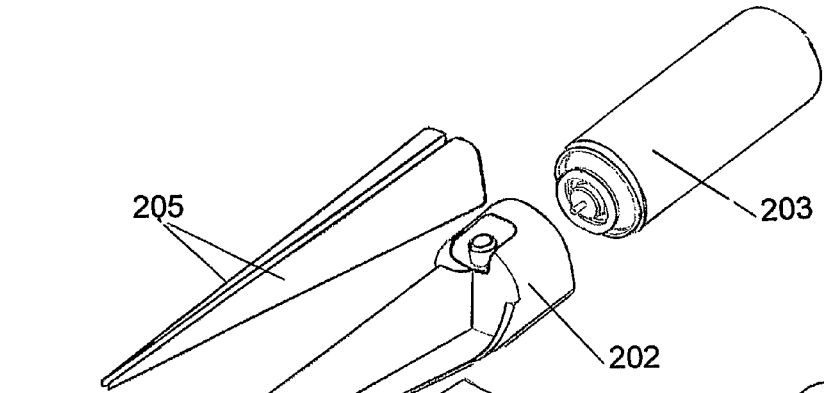

FIG. 20—Shows an exploded view of large Tool with lance shaped first face

Figure 21:
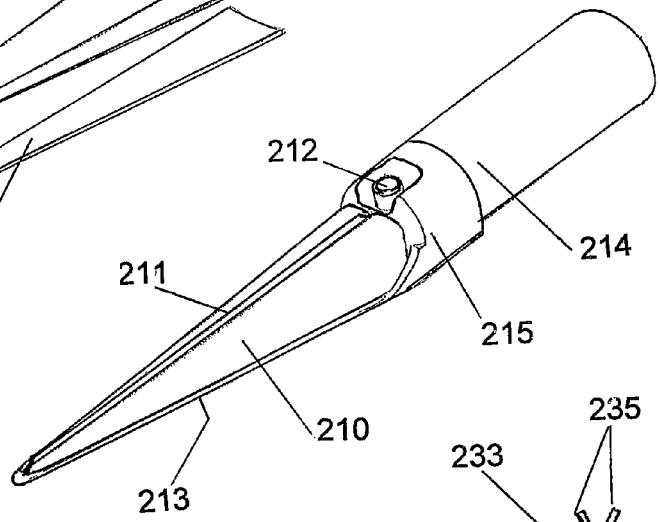
Figure 22:
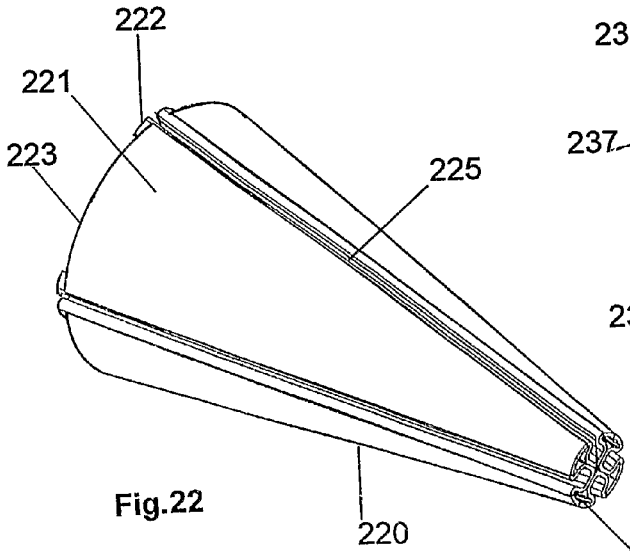
Figure 23:
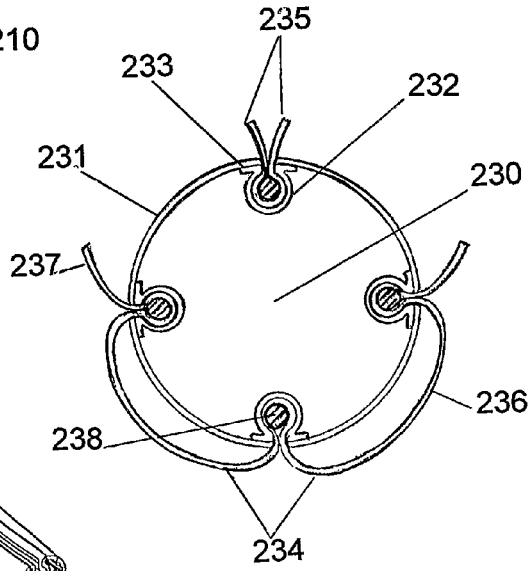

FIG. 21—Shows the lance Tool of FIG. 20 assembled as a window cleaning aid FIG. 22—Shows a Tool with grooved conical spined portion and detachable fins FIG. 23—Shows a cross section of the conical Tool of FIG. 22

EXAMPLE 1

Means of Making Basic Tools

FIG. 1 illustrates the first stage of a manufacturing process for making a basic Tool as described hereinbefore. A shape (1) is created from flat sheet; this pre-formed shape is illustrated with rounded distal end (2) curved sides (3) and shaped proximal end (4) carrying location holes (8) of any convenient size. Broken lines (5, 6, 7) are fold lines and these may be optionally indented flat to facilitate folding later, especially if using card.

The shape and size of the pre-form is scaled up or down to suit the application. Tools are considered small if distance between distal and proximal ends (5) is less than 100 mm, medium size Tools are between 100 and 200, any Tool longer is considered large. The relationship between depth of face (5) and width (9) is usually about 1:1 but varies from 5:1 for blade like Tools to 1:5 for mop like Tools.

Typical materials used being card that is waterproofed by laminating with 25 micron polythene film. Alternatively the preform can be cut from polyolefin film for example polypropylene (PP) sheet or a metal foil such as aluminium or stainless steel. The outer holdable surfaces on small Tools were further covered with a 50μ layer of TPU to improve finger grip. Small Tools were typically made from 500μ card or 300μ polymer film alone or 100μ annealed metal foil like aluminium alloy like 6082 T4. Medium Tools typically made from 1000μ card or 500μ film or 200μ foil. Large Tools tend to use 600μ film upwards and 250μ upwards foils. When laminates are used they often employ card and are therefore of similar thickness to the figures quoted above for card. The card is printed before pre-forming. The card pre-forms for the prototype Tools were laminated after cutting to shape to ensure the edges were sealed.

Referring again to FIG. 1 the cut out shown (1) is fold-formed by bending along broken line (5) to form a narrow radial face (20) FIG. 2 that is straight and acts as a narrow face for wiping and scrapping. The flat faces (21) are further fold-formed by bending again along broken line (22) to create the basic Tool shape of FIG. 3 with bend (35). This shape has a central tapered spined-portion (30) tapering from proximal end (31) to distal end (32) with shaped fins (33) and (34). The under faces (36) and (37) of the laterally protruding fins (33) and (34) are first face of the Tool. (38) shows the hollow space within spined portion (30) and (39) is the second face and is a radial face at top edge of the tapered spined-portion (30) (also shown as (20) in FIG. 2). (39) is a wiping edge that is separate from the rubbing face (36,37).

FIG. 4 illustrates how the process outlined in FIGS. 1, 2 and 3 can be extended to create a Tool with a conical shaped spined-portion (40), by forming the folded spined-portion of FIG. 3 (30) into a cone with a hollow circular cross-section (41) at proximal end. A dorsal fin (42) is fold formed and runs down the conical spined-portion to Tool distal end (45). The gap (44) at the base of the cone can be closed and sealed to improve mechanical stiffness creating a strong ring at proximal end (43) which if made with plastic can be further thermoformed into a dispenser cap, or thermo-welded or otherwise bonded on to a dispenser mounting ring. The stiffness of the cone (46) reduces as it approaches distal end (45). The cone (40, 46) stiffens and supports the fins (48, 49) and the underface (47) forms a continuous uninterrupted first face.

Although not shown it is evident that the process described above can be extended to form a multiplicity of spined-portions on the same Tool by pre-forming and bending appropriately. Equally this same process can be used to create spined-portions with a wide variety of cross section shapes.

Whilst it will be evident to those experienced in the field it is worth mentioning that card can be bent cold, but laminated cards is best warmed to about half the laminate melting temperature before bending. Tools made with polymer sheet are bent after selectively softening with hot wires, the sheets being folded over the wires as the material soften. In the case of polypropylene the temperature of the wires must be kept below the melting point of about 170° C. and ideally limited to less than 120° C. at which the plastic retains appropriate mechanical strength. Metal Tools are cold providing the metals are annealed to T4 in the case of aluminium. Sharp edges on metal or plastic Tools are dangerous and should be removed during manufacturing.

EXAMPLE 2

Means of Incorporating Dispensers Into Small Tools

Small Tools are small enough to be held and gripped by fingers during use and therefore it is often convenient to incorporate the dispenser into the Tool itself. On the other hand pencil shaped dispensers or slender pump like bodies, for example like those used with hypodermic needles can also be used with small Tools and these pencil Tools are attached or joined onto the Tool externally, in which case the attached dispenser may be used to hold the small Tool during use. By way of example three ways of incorporating dispensers into small Tools are now shown.

Referring to FIG. 5, a Tool with a fin (50) and first face (54) is similar to Tool shown in FIG. 3 but with an enlarged hole (51) surrounded by a thin retaining ring (52) and the folded spined portion is shown opened slightly (53) and this may be sprung open further to allow the capsule shown in FIG. 6 to be inserted into hole (51).

FIG. 6 shows the capsule that contains stuff to be dispensed. The capsule resembles a single thermoformed blister element like those used for blister-packing pills. It comprise a shallow thermo-formed circular tray (60) with flange (61) with outer profile rounded on one side (62) to match the profile of the proximal end of spined-portion (51) and (52) in FIG. 5. The flange also has a rectangular section (63) that locates inside the folded spined-portion to prevent it rotating once inserted into hole (51) in FIG. 5. The above thermoformed shape may be sealed with a flat backing sheet (65), or mounted back to back with a mirrored form (not shown) to double the capacity of the capsule. Alternatively the two mirrored sections may be divided with a sheet (not shown) to provide two independently sealed cavities (60). The two cavities may be used to dispense similar or dissimilar stuff during use. Means are provided for opening the capsule cavity before dispensing such as a hollow pip (64) is moulded into the flange that may be opened by trimming the corner (66) off the capsule.

Other means may be used for opening and releasing the capsule contents such with peel off patches or peeling back adhering faces or removing a bung or stopper to allow stuff to be squeezed out. By control of orifice size the proportions of dissimilar materials may be controlled during dispensing. The materials used for making these capsules will need to have appropriate barrier layer properties and will probably be one of those that are thermo-formable and transparent as used in blister packing pharmaceuticals. It is highly desirable to make (60) transparent so that users can see how much fluid remains to be dispensed.

An example of the suitable thermo-formable barrier material being a cyclo-olefine copolymer (COC) marketed under the trade name AMPARIS (a registered trade name of Alcan Group) or a PVC-CTFE fluoro-polymer films made from PVC and ACLAR (a registered trade mark of Honeywell Inc). Generally the material thickness is in the range 100 to 300 microns. Typically the capacity of a capsule is in the range 1 to 10 ml.

FIG. 5 also shows the folded spined-portion is sprung slightly opened (53) which is sufficient space for the small triangular shaped sachet shown in FIG. 7 to be inserted and this is a second means of incorporating a dispenser element. A triangular pouch shaped container (70) is shaped to fit within a folded spined-portion at (53) in FIG. 5. The pouch made by cutting a sheet in the profile of an equilateral triangle and then folding along its centre (71) and welding along its vertical edge (72) and its tapering edge (73). Again the capacity of this container is in the region 1 to 10 ml. The materials used in this construction are likely to require the protection of a barrier layer, and they may be similar to those used in the capsule of FIG. 6. If the contents of the transparent pouch must be visible then the pouch must be made with transparent material and a cut away can be provided in the spined-portion through which to view the pouch. If for any reason the contents of the pouch need to be protected from light then a aluminium barrier film placed within a thermo welded polyethylene outer layer of a pouch works well. Alternatively, heat sealable laminated foils with aluminium or ceramic barriers used extensively in food packaging are ideal for making long life pouches. The contents of the pouch are released by cutting the distal tip (74) off the pouch. An alternative means of opening the pouch being to peel off a sealing flap appropriately retained by a frangible seal, these practices already commonly used within the packaging art.

FIG. 8 shows a third means of dispensing fluids from a small Tool. A thermoformed layered sheet (80), with sealed cavities for storing and dispensing fluids there from during rubbing. The sheet thickness (81) determines the storage volume. The sheet is attached to the under-face of the fins (54) in FIG. 5 by for example adhesive, hook and loop fibres or as a slip-on shoe with straps (82) or folded over edges. The sheet (80) is capable of retaining stuff and releasing it progressively during rubbing. Such layered sheets may be made from foams or fibres or formed films incorporating storage cavities as disclosed in our earlier application published as WO 2005/018879 and mentioned herein before.

EXAMPLE 3

Techniques for Handling and Using the Small Tool

The small Tools are hand held and typically range up to 100 mm from distal to proximal end. Average human index and second fingers range from 60 to 90 mm long, thus the small Tools are sized to be held by these fingers and in some cases fingers and the thumb. Generally small tools find most use in skin care, cosmetics, first aid and artistic applications.

FIG. 9 shows a small Tool gripped on spined-portion (90) for rubbing, held towards proximal end (91) between thumb (92) and index finger (93) and second finger (94). During rubbing the Tool is placed in frictional contact with a surface and rubbed in some combination of the direction arrows (95, 96) (97). Also shown in FIG. 9 is a swab pad (98) mounted above the fin (99).

FIG. 10 shows the Tool inverted for wiping and scraping, held between the same fingers as above. The wiping face (100) (Tool second face) is moved in the direction of arrows (101) to scrape residues into a position where they can be swabbed up. The first face is shown inverted (102).

FIG. 11 shows how the Tool is used for swabbing by positioning the swab (112) located on the back of the fins against a surface. For this the spined portion (113) is positioned parallel to surface and is pressed against a surface in direction of arrow (110) as it is gripped and deformed (111). The fins being flexible allow the swab shown (98) in FIG. 9 to be folded under the Tool (112) as it is pressed down in direction (110) by finger force applied to the bent up proximal end (111) so that the swab (112) is in contact with treatable surface and can soak up residues. The material used for the swab (112) must be absorbent and desirably able to collect up particulate by wiping. For this there may be more than one layer used for example an under layer of micro fibre or foam for absorbing fluid covered with an open weave non-woven layer that collects and holds particulate between fibres.

FIG. 12 shows how a small Tool (120) may be held between index (121) and second finger (122) for applying treatments to a human face while retaining maximum visibility via mirror (124) via vectors (125, 126). This grip is useful when using the Tool to access difficult places and when very careful control is required. The example shows a Tool being used to treat the side of the nose (123). Other uses for the Tool held by this grip is for example artistic painting, where the Tool is used for applying and spreading paint with the tip for fine lines and the full first face for large areas. Further effects are obtained by scraping and swabbing.

EXAMPLE 4

Construction of Medium Size Tools

Medium size Tools are scaled up versions of the small Tools, the distance between their distal and proximal ends being within the range of 100 mm to 200 mm on spined-portion. Generally these sized tools are useful for domestic cleaning.

FIG. 13 shows a medium size Tool with spined-portion (130) approximately 150 mm long pivotally coupled with a coupling (131) pivoting at point (135) on a button pump body (132) carrying a button (133), the pump body (132) joined to a 300 ml storage bottle (134), the outside of the storage bottle used as a handle, with which to hold the Tool. The coupling (131) has two pivot points, the first (135) pivots on the pump body (132) and the second (136) pivots on the spined-portion (130). Stuff is dispensed via tube (137) shown located at Tool distal end. When using the Tool and holding the storage bottle (134) the index finger is pressed against pad (138) to control the pivoting rubbing face (139) and hold it against the treatable surface.

The pivoting Tool can be folded over to position the rubbing face parallel with the storage bottle, the rubbing face facing inwards for storage and outwards for use as a doubled up Tool.

FIG. 14 shows a similar sized Tool to that in FIG. 13, but shown pivotally coupled by pin (140) to a clevis (141) that is mounted on a rotate-able sleeve (142) that is in turn mounted on an extension shaft (143).

The Tool shown in FIG. 14 can be coupled to a remote dispenser via plastic hose (not shown) to minimise weight on the extension pole (143). Also the angle of the Tool can be remotely controlled by levers (not shown) to facilitate remote use of the under rubbing face (146) and scraper edge (147) and swabbing bulk (148). A slip on shoe or 'slip-on' cover (144) is shown placed over the fins (145).

This configuration is useful for use as a mop for cleaning floors and walls. Although the illustration shows a mechanical coupling that pivots in two axis, first about pin (140) and second shaft (143) rotates in sleeve (142), a third axis can be added that is normal to pin (140) and this is helpful on mops.

FIG. 15 shows the fin cover shoe removed from the Tool shown in FIG. 14. This 'slip on' device can in it's simplest form be a folded non-woven wipe, ranging up to a multi-layered absorbent structure incorporating a stuff carrying foam layer encapsulated or sealed in an open-able plastic pouch; or a layer of formed film carrying stuff for release during rubbing. The 'slip-on' has a stretchable opening (150) with first rounded end (151) that locates at the distal end of spined-portion and a second rounded end (152) locates towards the proximal end of spined-portion. First face (153) is located under and swabbing areas (154) are provided on top.

FIG. 16 shows a medium size hand held Tool combination comprising a Tool with cone shaped spined-portion (160) approximately 150 mm long supporting laterally disposed fins (161, 162) spanning approximately 100 mm with rubbing face there-under (163). A wiping/scraping edge (164) traverses the cone (160) to be used as a scraper or squeegee edge. (168) is an absorbent foam bulk placed on third face of the Tool. A 'clip-on' coupling or mounting ring (165) is attached at cone proximal end and shaped to clip onto an aerosol or similar container (166). (167) is the aerosol operating button and the aerosol spray (169) is directed downwards.

EXAMPLE 5

Construction and Uses for Large Tool

FIG. 17 shows a large Tool and these are useful for treating large surfaces such as automobile bodies or wheels. The Tool comprises a cone shaped spine portion (170) typically longer than 200 mm and can be made by the method shown in FIGS. 1 to 4. The stiff spined-portion (170) tapers towards the Tool's distal end (174) with laterally extending finlike protrusions (171, 172) appended thereto; carrying a rubbing capability on first face, the example shown being a layered stack (177) of rubbing material.

In a large Tool embodiment the cone (170) supports larger fins (171) and (172) that often require selective stiffening by imprinting a pattern of protrusions (173) into the fins that act rather like the structural spars in aircraft fins in that they are stiff but slightly flexible. As a result although the fins still remain flexibly deformable they can now support heavy duty large area rubbing faces. Examples of uses of these strengthened fins are as follows.

First, Tools used for treating large surface areas may carry a stack of detachable rubbing pads or sheets (177) that are attached onto the Tool first face, the under-face of finlike protrusions (171, 172). The sheets or pads of the stack may be made of fibres, the fibres pads may be any of those commonly used for rubbing as listed earlier herein. Of particular interest are pads with fibres spaced to retain stuff between fibres such as multiple layers of removable compressed abrasive fibres as disclosed in our earlier application International Publication Number WO01/87499 A1. These pads are joined together with frangible beads of hot melt adhesives (175) run down the outer edges of the stack and optionally down the edges of the centre hole. The frangible beads allow used layers (176) to be peeled off after use to reveal new clean rubbing faces. A typical hot melt supplied by H B Fuller Inc. under their mark 4164 was found to be suitably frangible when joining layers of 3M ScotchBrite non-woven abrasive (ScotchBrite being a registered mark of 3M Inc.). The same adhesive is used to attach the stack (177) to the fin (171, 172) under-sides.

Optionally the sides and back of the peel off layers are protected by thermo-shrinking a thin plastic isolating film over and down the sides of each layer (178) to prevent unused layers becoming contaminated during use. Care is needed to ensure the isolating film is securely bonded to the rubbing pads on the inside of the film in the region of the frangible outer ties to preserve stack strength stiffness. Aerosol is sprayed through hole (179).

If as shown in FIGS. 17, 18 and 19 the finlike protrusions are stiffened and the stiffening protrusions intersect the cone the fin can no longer hinge. An advantage of this is that a vibrator can now be placed inside the cone and the vibrations generated are distributed through the stiff star pattern.

FIG. 18 shows how a vibrator is incorporated into a Tool's cone shaped spine-portion, this Tool first designed for cleaning car wheels. The Tool work face is shown covered by bristle brush (180) and the profile of the cone is shown by broken lines (181). The vibrator comprising a battery pack (182) of 8 off 1.5 v AA size primary or secondary batteries (non-rechargeable or re-chargeable), the battery mass supported on a structure attached to the Tool mounting ring (183) that is in turn attached to a hand holdable handle or dispenser container (184). An electric motor (185) is positioned in front of the batteries in such a way that the mass of the motor is independent of the larger mass of the batteries. The motor (185) is bonded into the cone where the star (186) intersects the cone. Upon rotation the motor spins and the eccentric weight (187) displaces the motor cyclically during rotation causing vibrations to be transmitted via flexible cone (181) into the star (186) and across the fins into brush (180), the vibrations assist rubbing and propel the Tool sideways.

The sideway propulsion occurs because the rotating eccentric weight causes a higher contact force as the weight travels towards the treatable surface than when it travels away, the higher force causing higher friction and more grip in one direction hence there is a net displacement. The direction of travel being determined by the direction of rotation of the motor, thus by reversing the battery polarity to the motor with a reversing switch (not shown in the diagram), the direction of travel of the Tool is reversed.

FIG. 19 shows a Tool of approximately similar proportions to that in FIG. 18, but with the dispenser reservoir removed to a remote position and connected via plastic hose (190) connecting it to a dispensing head handle (191) coupled to Tool body (192). A button (193) on the dispensing head controls the dispensing of stuff. There may be an optional motor vibrator concealed in the Tool body (192) controlled by an electrical reversing switch (194) positioned on the Tool mounting ring. The electrical power source to drive the vibrator may optionally be removed from the cone and connected to the Tool via electrical cables (199), for example this car washing tool can be connected to the automobile battery. The rubbing surface (196) is shown as a brush and is mounted under fins (197,198). This is shown as a different shape to the rubbing surface in FIG. 18 to illustrate how that shape can be varied. The wiping face or scraper (195) is shown in same position as previously (42) in FIG. 4. Although not shown swabs can be attached onto the top of fins (197) and (198) towards their out more flexible regions.

It should be noted that the nature of the treatable surface and the nature of the rubbing face and the shape and stiffness of the fin protrusions all influence the effectiveness of the vibration induced propulsion, as does the means of holding the Tool against the surface during vibration because they all influence rubbing friction between the Tool and treatable surface. Generally these parameters are best optimised by iterative trials. The Tool shapes shown in FIGS. 18 and 19 were found to be effective for cleaning car body-work and aircraft surfaces and also the complex shapes encountered on aluminium car wheels, using brush elements cut from a sheet of artificial turf.

EXAMPLE 6

Construction of a Narrow Tool for Window Cleaning

FIG. 20 shows an exploded view of the component parts of a Tool that is blade like and is ideal for window cleaning, especially reaching into inaccessible places like the inside lower areas on low angled windscreens in automobiles. The Tool with spined-portion (200) carrying long narrow finlike protrusions (201, 207) joined to a mounting ring (202) that clips onto an aerosol applicator Tool (203). (204) is a rough layer that is attached to the first face, the under-face of (201, 207). The top edge of the spined-portion (206) is for wiping. Two tapering wedge shaped forms of soft absorbent material (205) attached to the over-face of (201, 207) and are used for swabbing. The absorbent materials are typically either foam or non-woven micro fibre-pad and most swab materials can left to dry out after use ready for further use.

FIG. 21 shows the Tool assembled from the components parts previously shown in FIG. 20. The Tool with first face (213) covered with rough covering and scrapper (211) standing proud off absorbent wedges (210), positioned so that scraped up residues are directed onto absorbent surfaces and absorbed. The Tool is connected to aerosol dispenser (214) by clipping into the mounting (215). There is integrally moulded into the mounting ring a hinged actuator button (212) to control the dispensing action of the aerosol. The aerosol jet is directed downwards through a hole in the first face.

EXAMPLE 7

Construction of Tools with Detachably Attached Finlike Protrusions

FIG. 22 shows an alternative construction for a spined-portion in which the lateral protrusions are formed to point inwards into the cone rather than outwards as is the case with the previous examples. The inward protrusions form slots in the outer surface of the cone, into which slot separate finlike appendages are inserted and retained. This construction can be made by fold-forming a cut-out pre-form as shown in FIGS. 1 to 4 and can be used to shape a body as claimed in claim 1.

Experience showed that it was difficult to optimise the stiffness of the retaining slots with satisfactory overall flexibility of the cone. Therefore an alternative construction was developed where the groves where extruded (222) from stiff material and the curved sectors (221) between the groves were made of highly flexible and resilient sheet, these sections (221, 222) being welded together flat then wrapped round to form the cone shape (220) of FIG. 22. The construction is useful for inserting finlike shapes into the groves (225) these fins being detachably retained.

In this construction the sections (221) are resiliently deformable and may be creased so that the sectors (221) concertina as the cone is squeezed. The grooved sections (222) are stiff enough not to open during this squeezing. The cone therefore is sprung outwards as shown in (220) but when gripped and squeezed inwards towards its proximal end (223) the cone is compressed and concertinas inwards to expel air from the cone. The stiff extruded grooved sections (222) pivot about distal end and maintain axial stiffness and the cone springs out to recover its original shape when relaxed.

This construction using four sectors was found useful for puffing air, either blowing or sucking via distal end (224), controlled by adding internal flap valves at proximal end (not shown). Furthermore this construction may be used with a dispenser that is either remotely coupled to the Tool or is used with the puffer action to develop a fine spray with Venturi tube placed at the distal end (224).

The Tool is gripped towards it proximal end (223) and is sized to be held and operated by an adult hand. For simplicity the internally mounted flap valves and associated mounts and end seals are not shown, neither are associated filters that can be incorporated into the cone-portion to create miniature manually operated Tools that are used like hand held suction cleaners. Other configurations of this construction can employ more or less than the four segment design illustrated, but the four segment design was found satisfactory for puffing.

FIG. 23—shows the cross section view of a spined-portion (230) comprising four flexible and resilient segments (231) that are joined by four stiff separately extruded grove sections (232) that are seam welded at (233) to collectively form the circular cross section of the cone shape shown in FIG. 22. The appended flexible finlike materials (234) constitute the first face, the rubbing face, and (235) is the second face, the wiping face that is from distant from rubbing face (234). The rubbing material of face (234) although shown similar is actually made rougher than the wiping material (235). The appended materials (234, 235) are shown loosely fitted because they are thin and rather more flexible than the appended fins shown in earlier examples. These examples of more flexible appendages are typically made of non-woven fibres as commonly used in wipes. The materials are secured into the groves by spring action (232). A number of variations of attachment are possible and it depends upon how many groves are used, for example (236) shows a looped arrangement that resembles a floppy finlike protrusion whereas (237) shows a single finlike flap. In either case the finlike protrusions are floppy and fold back against the cone during rubbing.

An alternative shape for the tapered spine-portion may be flat with a grove in the top and bottom edge for inserting detachable finlike protrusions into. There are many possibilities for cross section shapes, either hollow or solid flat sections and the invention embraces any cross section shape of tapered spine-portion carrying a multiplicity of lateral finlike protrusions, either permanently attached or detachably attached into groves thereon.

If the coned portion is made by the method illustrated in FIGS. 1 to 4 the formed inward pointing protrusions (groves) may lack axial stiffness. This is overcome by inserting stiffening rods (238) into the formed groves (232) and the finlike material wraps around the rod and is retained trapped between rod and groove wall (232).

Alternatively the appendages can be made stiffer more like the earlier finlike appendages in earlier examples.

This Tool with resiliently compressible spined-portion (220) was found suitable for use with electrostatically charged wipes (234, 235, 237) secured to its surface by insertion into sprung groves and used to collect dust. A flexible flap valve towards the proximal end (not shown) prevents air escaping as the cone is squeezed; the displaced air is dispensed from the distal end (224) as a jet that was found useful for blowing dust out of inaccessible places so that it is collectable with electrostatic wipes. A motor driven fan can be incorporated within the cone shape to provide blowing and sucking arranged somewhat like that shown in FIG. 18.

The invention claimed is:

1. A tool: (1) which can be used effectively to treat a surface by applying stuff to the surface, by rubbing the surface to spread the stuff over the surface, and by wiping residue of the stuff off the surface; (2) which includes a distal end and a proximal end; and (3) which also comprises:

(A) a folded, resilient, flexibly deformable sheet in a form which includes:

(i) a centrally positioned, tapered, stiff, upstanding, hollow spined-portion: (a) that includes a top edge which is folded; and (b) that narrows toward the distal end of the tool and is shaped toward its proximal end for holding the tool; (c) the folded top edge of the sheet formed by folding the sheet along a centrally positioned fold line of the sheet; and (d) the tapered spined portion formed by folding the sheet along two fold lines which are spaced from the centrally positioned fold line, one on one side thereof and the second on the other side thereof, and both angled thereto and to each other, (ii) a pair of opposed fins that extend laterally of and in opposite directions and along the lower lengths of the spined-portion and that in combined form have underfaces and upperfaces that are flat with respect to each other; and (B) a material: (i) which is suitable for applying the stuff to the surface and for rubbing said surface to spread the stuff over the surface; and (ii) which is attached to the flat underfaces of said opposed fins and provides the underfaces with a continuous gap-free rubbing surface.

2. A tool according to claim 1, wherein the tapered spined-portion is hollow over part of its length.

3. A tool according to claim 1, wherein the tapered spined-portion is hollow over all of its length.

4. A tool according to claim 1 having wiping faces that include the upperface of said fin and an adjoining face of the spined-portion.

5. A tool according to claim 4 wherein one or more of the wiping faces has attached thereto a material that absorbs fluids.

6. A tool according to claim 1, wherein said material of (B) is one or more of: (a) a woven or a non-woven web of natural or synthetic fibres, with or without abrasive; (b) wire wool; (c) coated abrasive; (d) formed film; (e) foam; or (f) a bristled sheet.

7. A tool as claimed in claim 1, wherein the underfaces are stiffer where they run along the lower ends of the spined-portion and become more supple away from the spined-portion.

8. A tool according to claim 1, wherein the sheet is resilient thick paper, cardboard, rubber, plastic foam or film, plastic/rubber blends or metal foil or a laminated combination of one or more thereof.

9. A tool according to claim 1 wherein the sheet comprises a polyolefin.

10. A tool according to claim 9 wherein the polyolefin comprises a polypropylene.

11. A tool according to claim 1 wherein the material of the underfaces comprises a rough material or is covered with a rough material.

12. A tool according to claim 1 wherein the material which comprises said sheet is plastic and wherein the form of the plastic sheet is made by injection molding or by thermoforming.

13. A tool according to claim 1 wherein said stuff is included in the attached material of (B) from which it is releasable during rubbing of the surface.

14. A tool which can be used to massage the skin effectively with stuff and to rub stuff on the surface of the skin and which includes a distal end and a proximal end and which also comprises:

(A) a folded, resilient, flexibly deformable sheet in a form which includes:

(i) a centrally positioned, tapered, stiff, upstanding, hollow spined-portion: (a) that includes a centrally disposed folded top edge; and (b) that narrows toward the distal end of the tool and is shaped toward its proximal end for holding the tool; (c) the folded top edge of the sheet formed by folding the sheet along a centrally positioned fold line of the sheet; and (d) the tapered spined portion formed by folding the sheet along two fold lines which are spaced from the centrally positioned fold line, one on one side thereof and the second on the other side thereof, and both angled thereto and to each other, (ii) a pair of opposed fins that extend laterally of and in opposite directions and along two opposed lower edges of the spined-portion, each of the edges being angled equally relative to said centrally disposed folded upper edge, the pair of fins, in combined form, having underfaces and upperfaces that are flat with respect to each other; and (B) a rubbing material which is attached to said flat underfaces of said opposed fins and which provides the underfaces with a continuous gap-free rubbing surface.

15. A tool according to claim 14 including a wiping face on the spined-portion and extending from the proximal end to the distal end.

16. A tool according to claim 14 wherein the material which comprises said sheet is selected from the group consisting of metal, plastic or cardboard which is protected from water ingression.

17. A tool according to claim 16 wherein said material is plastic.

18. A tool according to claim 17 wherein the form of the plastic sheet is made by thermoforming.

19. A tool according to claim 17 wherein the form of the plastic sheet is made by injection molding.

20. A tool according to claim 14 wherein the rubbing material comprises a thermoplastic elastomeric material.

21. A tool according to claim 14 wherein the rubbing material comprises a styrenic thermoplastic elastomeric material.

22. A tool according to claim 14 wherein the rubbing material comprises a thermoplastic urethane.

23. A tool according to claim 14 wherein the rubbing material comprises a rough material or is covered with a rough material.

24. A tool according to claim 14 wherein the rubbing material is a blown or cast film or an extruded thermoplastic elastomeric material having rubber-like physical properties.

25. A tool according to claim 14 wherein said stuff is included in the attached rubbing material of (B) from which it is releasable during rubbing of the surface.

* * * * *

UNITED STATES PATENT AND TRADEMARK OFFICE

CERTIFICATE OF CORRECTION

PATENT NO. : 8,272,801 B2
APPLICATION NO. : 11/569482
DATED : September 25, 2012
INVENTOR(S) : Linzell It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 579 days.

Signed and Sealed this
Tenth Day of June, 2014

Michelle K. Lee

Michelle K. Lee
*Deputy Director of the United States Patent and Trademark Office*